US007014525B2

(12) United States Patent
Abe et al.

(10) Patent No.: US 7,014,525 B2
(45) Date of Patent: Mar. 21, 2006

(54) MOVABLE TOY AND MOVABLE TOY SET FOR THE SAME

(75) Inventors: Takehiro Abe, Nagoya (JP); Masanori Takeda, Nagoya (JP)

(73) Assignee: The Pilot Ink Co., Ltd., Aichi (JP)

( * ) Notice: Subject to any disclaimer, the term of this patent is extended or adjusted under 35 U.S.C. 154(b) by 0 days.

(21) Appl. No.: 10/426,878

(22) Filed: May 1, 2003

(65) Prior Publication Data

US 2004/0002280 A1 Jan. 1, 2004

(30) Foreign Application Priority Data

May 2, 2002 (JP) ..... P2002-130415

(51) Int. Cl.
*A63H 30/00* (2006.01)

(52) U.S. Cl. ..... 446/175; 446/146

(58) Field of Classification Search ..... 446/146, 446/175, 14, 267

See application file for complete search history.

(56) References Cited

U.S. PATENT DOCUMENTS

| | | | | |
|---|---|---|---|---|
| 3,252,248 A | | 5/1966 | Zalkind | |
| 3,468,391 A | * | 9/1969 | Rushing et al. | 180/168 |
| 3,570,180 A | | 3/1971 | Oda et al. | |
| 3,596,401 A | | 8/1971 | Camire | |
| 3,606,933 A | * | 9/1971 | Rushing et al. | 180/168 |
| 3,648,373 A | * | 3/1972 | Morrison et al. | 33/18.1 |
| 4,152,867 A | | 5/1979 | Ogawa | |
| 4,658,928 A | | 4/1987 | Seo | |
| 4,662,854 A | * | 5/1987 | Fang | 446/175 |
| 4,925,424 A | * | 5/1990 | Takahashi | 446/175 |
| 5,011,445 A | * | 4/1991 | Nakasuji et al. | 446/14 |
| 5,752,870 A | * | 5/1998 | Karasawa et al. | 446/146 |
| 5,851,134 A | * | 12/1998 | Chiu | 446/468 |
| 5,871,385 A | * | 2/1999 | Hippely et al. | 446/424 |
| 6,149,490 A | * | 11/2000 | Hampton et al. | 446/353 |
| 6,695,668 B1 | * | 2/2004 | Donahue et al. | 446/175 |

FOREIGN PATENT DOCUMENTS

| | | | |
|---|---|---|---|
| DE | 3444426 A1 | * | 6/1986 |
| EP | 295332 A | * | 12/1988 |
| EP | 792669 A1 | * | 9/1997 |
| GB | 2205255 A | * | 12/1988 |
| JP | 59-36394 | | 3/1984 |
| JP | 04329993 A | * | 11/1992 |
| JP | 06007549 A | * | 1/1994 |
| JP | 06039151 A | * | 2/1994 |
| JP | 08336675 A | * | 12/1996 |
| JP | 2001327766 A | * | 11/2001 |

* cited by examiner

*Primary Examiner*—Derris H. Banks
*Assistant Examiner*—Urszula M. Cegielnik
(74) *Attorney, Agent, or Firm*—Sughrue Mion, PLLC

(57) ABSTRACT

A movable toy having movable bodies selected from the group consisting of at least a pair of wheels and leg portions which move when driven by a motor provided in the main toy body, wherein there is provided an energization detecting unit comprising at least three elements at the lower part of the main toy body and both or either of the movable bodies is selectively allowed to move depending on the energized state of the elements.

6 Claims, 9 Drawing Sheets

MOVABLE TOY AND MOVABLE TOY SET FOR THE SAME

BACKGROUND OF THE INVENTION

1. Field of the Invention

The present invention relates to a movable toy and a movable toy set for the same, more relates to the movable toy and a movable toy set for the same, which can run by itself depending on a detection of an energized state of a running surface.

2. Description of the Related Art

It has heretofore been disclosed in JP-UM-A-59-36394 that toys run by driving a motor, which rotates with an electric current passing through water.

In the related art, the toys are allowed to run or stop in the presence or absence of water. Thus, the toys which keep running can be provided with variability of running.

However, the moving direction of the toys is in a constant direction so that the toys cannot be arbitrarily varied. Thus, the toys run along a monotonous locus and lack variability. Thus, the toys soon become boring.

SUMMARY OF THE INVENTION

It is an object of the invention to provide a movable toy a running locus of which can be complicatedly and arbitrarily predetermined to give surprise and variety in running and hence high toy properties.

The essence of the invention lies in a movable toy comprising movable bodies selected from the group consisting of at least a pair of wheels and leg portions which move when driven by a motor provided in the main toy body, wherein there is provided an energization detecting unit comprising at least three elements at the lower part of the main toy body and both or either of the movable bodies is selectively allowed to move depending on the energized state of the elements or a movable toy comprising wheels which move when driven by a motor provided in the main toy body, wherein there is provided an energization detecting unit comprising at least three elements at the lower part of the main toy body and the wheels are displaced depending on the energized state of the elements.

The essence of the invention further lies in a movable toy set comprising the movable toy and a water adhesion unit or a movable toy set comprising the movable toy set, the water adhesion unit and a water-discolorable sheet material.

The energization detecting unit having three elements is provided in the main body of the movable toy. Both or either of the movable bodies is selectively allowed to move depending on the energized state of the elements.

Explaining the energization detecting unit in detail in connection with the attached drawings, an electrically-conductive locus is previously formed on the surface of the track for a movable toy having three elements 6, 7 and 8 at the lower part of the main toy body. While the toy runs with its three elements contacted with the electrically-conductive locus, the toy go straight by rotating the wheels of the movable body when all the three elements are energized (FIG. 1).

When the toy approaches a right curve, the element 8 is no longer energized and only the elements 6 and 7 are energized. Thus, only the left rear wheel of the movable body is rotated so that the toy takes right turn (FIG. 2).

When the toy approaches a left curve, the element 7 is no longer energized and only the elements 6 and 8 are energized. Thus, only the right rear wheel is rotated so that the toy takes a left turn (FIG. 3).

After taking a right or left turn, the toy is energized again at all the three elements to go straight ahead. Thus, the toy can never run off the track.

In the above-description, the two elements of the energization detecting unit are positioned ahead and the rest is positioned rear. For example, the three elements may be positioned in a line perpendicular to the movable direction of the toy so that the same effect can be obtained as mentioned above (FIG. 6).

When the movable toy runs off the track, it is preferable that the toy may rotate in right hand or left hand by changing the direction of the wheels on a condition that all three elements are deenergized so that the movable toy can avoid moving away from the track. When the movable toy runs off the track, the rotation of the wheels may be stopped on the condition that all three elements are deenergized. When the movable toy runs off the track, the movable toy may rotate in a predetermined direction and in a predetermined time on the condition that all three elements are deenergized, and then the movable toy may be stopped.

In the above-description, the movable toy has at least a pair of wheels as the movable body so that both or either of the wheels is selectively allowed to move. However, the movable body is not limited to wheels. Human or animal legs may be used to realize the same operation as mentioned above.

The invention is not limited to the mechanism in which both or either of a pair of movable bodies is allowed to move. Any mechanisms that allow the toy to take a turn may be used to realize the same operation as mentioned above.

An electrically-conductive locus is previously formed on the surface of the track for a movable toy having three elements at the lower part of the main toy body. While the toy runs with its three elements contacted with the electrically-conductive locus, the toy goes straight by rotating the wheels of the movable body when all the three elements are energized.

When the toy approaches a right curve, the element 8 is no longer energized and only the elements 6 and 7 are energized. Thus, only the left rear wheel of the movable body is rotated so that the toy takes right turn.

When the toy approaches a left curve, the element 7 is no longer energized and only the elements 6 and 8 are energized. Thus, only the right rear wheel is rotated so that the toy takes a left turn.

After taking a right or left turn, the toy is energized again at all the three elements to go straight ahead. Thus, the toy can never run off the track.

When the movable toy runs off the track, it is preferable that the toy may rotate in right hand or left hand by changing the direction of the wheels on a condition that all three elements are deenergized so that the movable toy can avoid moving away from the track. When the movable toy runs off the track, the rotation of the wheels may be stopped on the condition that all three elements are deenergized. When the movable toy runs off the track, the movable toy may rotate in a predetermined direction and in a predetermined time on the condition that all three elements are deenergized, and then the movable toy may be stopped.

The material of the main toy body is not specifically limited and may be a plastic, metal, wood or the like, preferably plastic. The main body may be in the form of automobile, train, human being, animal or the like.

The motor received in the main toy body is adapted to move the wheels or legs directly or via a gear. In the case of a mechanism provided with a movable body comprising at least a pair of wheels or legs, one motor may be used to move both the movable bodies or selectively move one of the movable bodies by switching the gear. Alternatively, two motors may be used to independently move the movable bodies.

Further, in the case where the wheels are rotated and moved corresponding to driving of motors, one motor may be used to rotate the wheels or change the direction of the wheels by switching the gear. Alternatively, two motors may be used to cause the rotation of the wheels and the movement of the wheels independently.

As a power supply for driving the motors there is preferably used a battery which may be of either primary type or secondary type. Alternatively, a solar cell may be incorporated in the toy so that an electric power can be obtained from a light source. An electric power may be externally supplied through a wire.

Further, if necessary, a switch or a sound-generating unit such as speaker may be provided.

As the switch there may be provided a switch for connecting or disconnecting the power supply, a switch for adjusting the volume or, if a plurality of electronic sounds are stored in a circuit board for controlling electronic sounds, a switch for selecting the electronic sounds.

Examples of the sounds informed by the sound-general formula unit include sound effects such as music, story and engine sound, human or animal voice, number counting sound, and letter or alphabet reading.

The electronic sound controlling circuit board for causing the speaker to generate a desired electronic sound comprises at least a portion for controlling the entire circuit, a portion for storing the control procedure and a portion for storing electronic sounds and converts sound data sequentially read from the portion for storing electronic sounds into a sound signal which is then generated from the speaker.

The motor, the power supply, and optionally the speaker and the circuit board for controlling electronic sounds are electrically connected to each other optionally via a switch.

The movable toy thus arranged is adapted to move on an electrically-conductive locus. The locus may be formed by connecting metal pieces. Alternatively, the locus may be formed on the surface of a sheet by metal pieces. In order to allow the user to form an arbitrary locus on which the toy can move, water is preferably used as the locus.

For example, by forming a locus on a floor by water, the toy can move on the locus, making it possible to further enhance toy properties.

Further, the movable toy may be combined with a water adhesion unit for causing the adhesion of water to form a movable toy set which can be used outdoor or in other places to which water can be difficultly attached. Alternatively, the movable toy may be combined with the water adhesion unit and a sheet material as a movable toy set.

The sheet material may be a synthetic resin sheet or cloth. The sheet material may be a water-discolorable sheet material, which has a porous layer. The porous layer has a low refractivity pigment, which fixed and dispersed in a binder resin on a surface of a support member of the sheet. The porous layer has difference in transparency between when the sheet material absorbs liquid and when the sheet material doesn't absorb liquid. Therefore, such a sheet material can be used to visually observe the color tone of the lower layer when the porous layer absorbs liquid so that the locus can be definitely confirmed.

The support member of the sheet material includes cloth such as woven fabric, knit, braid, and nonwoven cloth. Other examples of the support include paper, synthetic paper, synthetic leather, plastic, glass, pottery, wood, and stone. These materials are all useful.

As the cloth to be used as the support member for the water-discolorable sheet material there is preferably used a woven fabric having an excellent surface smoothness from the standpoint of film-forming properties of the porous layer.

In the case where the cloth used has a poor surface smoothness or has a great ink permeability to provide the porous layer with deteriorated film-forming properties, the cloth can be subjected to treatment such as water repellent treatment to provide the porous layer with improved film-forming properties.

The cloth, if used, preferably has a weight of from 30 to 1,000 g/m$^2$. When the cloth has a weight of less than 30 g/m$^2$, the cloth has a heterogeneous and insufficient water absorption, making it difficult to visually recognize the definite color tone of the lower layer. On the contrary, when the cloth has a weight of greater than 1,000 g/m$^2$, the cloth has a greater thickness than necessary, deteriorating the storability in folded form, adding to the weight thereof and impairing the economy when the sheet itself has a large area.

A resin layer having a thickness of from about 1 $\mu$m to 3 mm made of a soft plastic such as polyolefin-based resin and vinyl chloride resin blended with a plasticizer or a thermoplastic resin such as styrene-based resin, urethane-based resin, polyester-based resin, polyamide-based resin, polybutadiene-based resin and fluororesin may be stuck to the lower surface of the cloth by a general-purpose means to form a laminate.

In the laminate system, when the thickness of the resin layer falls below 1 $\mu$m, the resulting laminate has an insufficient durability. On the contrary, when the thickness of the resin layer exceeds 3 mm, the resulting laminate finds difficulty in its foldability. The lamination of the resin layer makes it possible to prevent contamination due to leakage of water from the back surface of the sheet occurring when water is accidentally spilt on the sheet or the absorption of water by the sheet is supersaturated and inhibit slippage.

The porous layer on the support member is formed by fixing a low refractivity pigment in dispersion with a binder resin.

Examples of the low refractivity pigment include particulate silicate, barytes powder, precipitated barium sulfate, barium carbonate, precipitated calcium carbonate, gypsum, clay, talc, alumina white, and basic magnesium carbonate. These materials have a refractive index of from 1.4 to 1.7 and exhibit a good transparency when they absorb water.

The particle diameter of the low refractivity pigments is not specifically limited but is preferably from 0.03 $\mu$m to 10.0 $\mu$m.

Two or more of these low refractivity pigments may be used in combination.

Preferred among these low refractivity pigments is particulate silicate. Particulate silicate is produced as an amorphous silicate. By production method, particulate silicates can be roughly divided into two groups, i.e., dry process silicate obtained by a gas phase reaction such as thermal decomposition of halogenated silicon such as silicon tetrachloride (hereinafter referred to as "dry process particulate silicate") and wet process silicate obtained by a liquid phase reaction such as decomposition of sodium silicate with an acid (hereinafter referred to as "wet process particulate silicate"). Either of the two silicates may be used. The wet process particulate silicate is preferred because it exhibits higher opacifying properties than the wet process particulate silicate in normal state, making it possible to raise the mixing proportion of the binder resin to the particulate silicate and hence enhance the strength of film having a porous pattern.

As the particulate silicate to be used to satisfy the opacifying properties of the porous pattern in normal state there is preferably used the wet process particulate silicate. This is because the dry process particulate silicate and the wet process particulate silicate differ from each other in structure. In some detail, the dry process particulate silicate has the following three-dimensional structure having silicic acid molecules densely bonded to each other:

[Three Dimensional Structure]

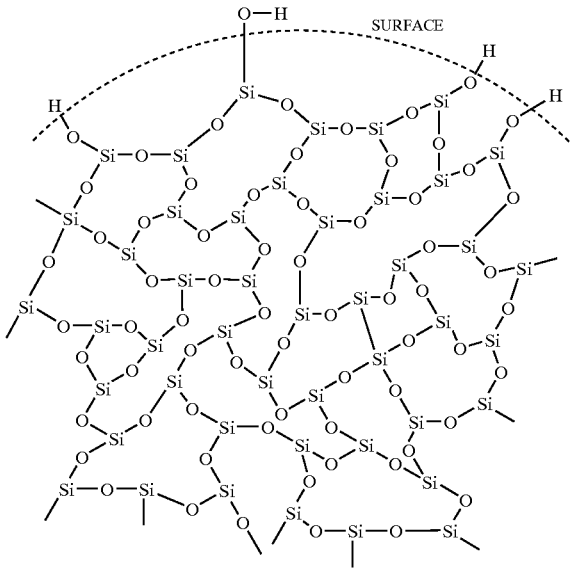

while the wet process particulate silicate has a so-called two-dimensional structure having a long molecular arrangement formed by condensation of silicic acid molecules. Accordingly, the wet process particulate silicate has a coarse molecular structure as compared with the dry process particulate silicate. It is thus presumed that the porous pattern formed by the wet process particulate silicate exhibits an excellent irregularity in reflection of light in dried state and hence high opacifying properties in normal state as compared with the system formed by the dry process particulate silicate.

[Two-dimensional Structure]

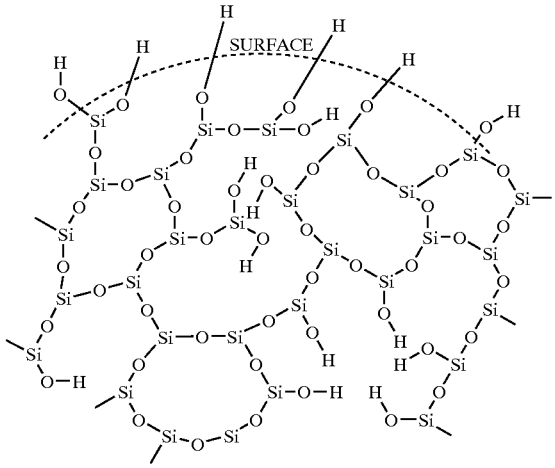

The low refractivity pigment to be contained in the porous layer preferably exhibits a proper hydrophilicity because the penetrating medium is mainly composed of water. The wet process particulate silicate has more hydroxyl groups present as silanol groups on the surface of particles and thus exhibits a higher hydrophilicity than the dry process particulate silicate. Thus, the wet process particulate silicate is suitable.

The coated amount of the wet process particulate silicate to be used as a low refractivity pigment is preferably from 1 to 30 g/m$^2$, more preferably from 5 to 20 g/m$^2$ to satisfy both the desired opacifying properties in normal state and the desired transparency in wet state, though depending on the kind and properties such as particle diameter, specific surface area and oil absorption of the wet process particulate silicate. When the coated amount of the wet process particulate silicate falls below 1 g/m$^2$, it is difficult to obtain sufficient opacifying properties in normal state. On the contrary, when the coated amount of the wet process particulate silicate exceeds 30 g/m$^2$, it is difficult to obtain a sufficient transparency in wet state.

The low refractivity pigment is dispersed in a vehicle containing a binder resin as a binder, and then applied to a support. The volatile content is then dried off to form a porous pattern.

Examples of the binder resin include urethane-based resin, nylon resin, vinyl acetate resin, acrylic acid ester resin, acrylic acid ester copolymer resin, acryl polyol resin, vinyl chloride-vinyl acetate copolymer resin, maleic acid resin, polyester resin, styrene resin, polyethylene resin, polycarbonate resin, epoxy resin, styrene-butadiene copolymer resin, acrylonitrile-butadiene resin, methyl methacrylate-butadiene copolymer resin, butadiene resin, chloroprene resin, melamine resin, emulsion thereof, casein, starch, cellulose derivative, polyvinyl alcohol, urea resin, phenol resin, and epoxy resin.

The porous layer has a smaller mixing proportion of binder resin to coloring material than known ordinary coat layer and thus can difficultly exhibit a sufficient strength. Accordingly, when used in purposes requiring washing fastness and scratch resistance, the porous layer preferably comprises the urethane-based resin or nylon resin as a binder resin or comprises at least these resins.

Examples of the urethane-based resin include polyester-based urethane resin, polycarbonate-based urethane resin, and polyether-based urethane resin. Two or more of these urethane-based resins may be used in combination. Alternatively, an urethane-based emulsion obtained by the emulsion dispersion of such a resin in water or a colloid-dispersed (ionomomer type) urethane resin obtained by subjecting an ionic urethane resin (urethane ionomomer) to self-emulsification with the ion group itself free of emulsifier to form an aqueous solution or dispersion may be used.

As the urethane-based resin there may be used either an aqueous urethane-based resin or an oil-based urethane resin. In practice, however, an aqueous urethane-based resin, particularly urethane-based emulsion resin or colloid-dispersed urethane-based resin is preferably used.

The urethane-based resin may be used singly or in combination with other binder resins depending on the kind of the support used or the required properties of the coat layer. In the case where binder resins other than urethane-based resin are used, it is preferred that the binder resin having a porous pattern have urethane-based resins incorporated therein in an amount of not smaller than 30% by weight as calculated in terms of solid content to obtain a practical film strength.

The binder resin, if it is crosslinkable, may be crosslinked with an arbitrary crosslinking agent to further enhance the film strength.

These binder resins have different affinities for medium. These binders may be properly combined to adjust the time and depth of penetration into the porous pattern and the speed of drying after penetration. Further, by properly adding a dispersing agent, the penetrating power can be controlled.

The porous layer may comprise a known metallic gloss pigment such as titanium dioxide-coated mica, iron oxide-titanium dioxide-coated mica, iron oxide-coated mica, guanine, sericite, basic lead carbonate, acidic lead arsenate and bismuth oxychloride or an ordinary dye, pigment or reversible heat-discolorable material incorporated thereon to make color change diversified.

The porous layer may be formed by a known method such as screen printing, offset printing, gravure printing, coating, pad printing, transferring, brush coating, spray coating, electrostatic coating, electrodeposition, curtain coating, roller coating and dip coating.

A non-discolorable layer made of a non-discolorable ink containing an ordinary dye or pigment or fluorescent dye or pigment or a metallic gloss pigment may be provided interposed between the support and porous layer.

Further, the provision of a heat-discolorable layer (image) containing a reversible heat-discolorable material which undergoes reversible discoloration with temperature change makes it possible to provide phase change with water as well as phase change with heat or cold.

In order to provide the water-discolorable sheet material with a locus, it is necessary that the porous layer absorb water.

The adhesion of water to the water-discolorable printed matter can be carried out by bringing finger wet with water into contact with the water-discolorable printed matter. A method involving the use of a coating device having a brush head or fiber pen at the forward end or a method which comprises applying water through a pen head member from a container for receiving water is preferably employed.

In particular, writing utensils or coating device comprising a pen head member such as porous plastic material, processed fiber and brush for introducing water from the container receiving water and discharging it is suitable for the movable toy set and has satisfactory portability and convenience.

DESCRIPTION OF THE PREFERRED EMBODIMENTS

Figure 1:
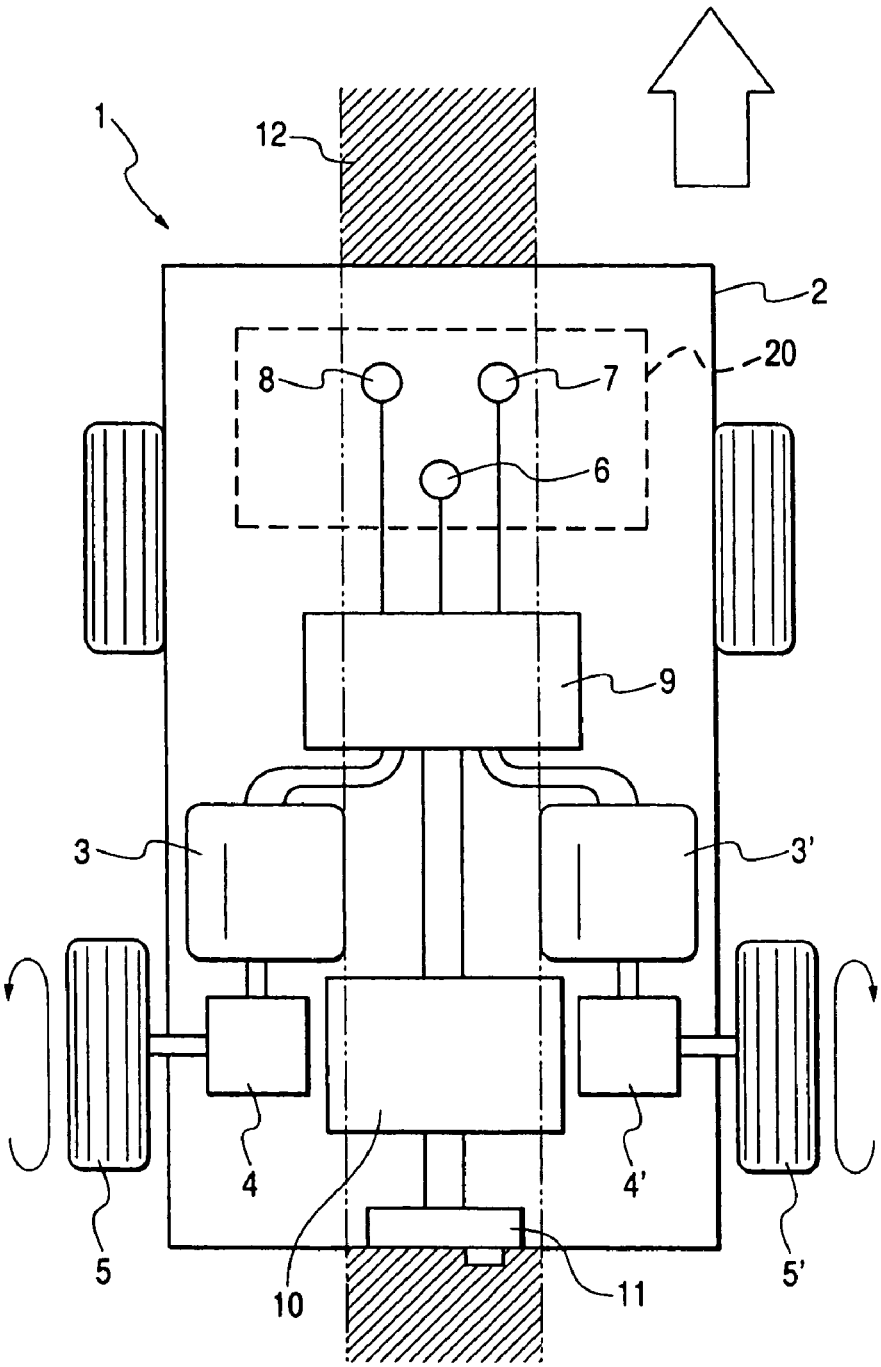
FIG. 1 is a diagram illustrating the state of a first embodiment of the movable toy of the invention as viewed from above.

In the embodiments, a movable toy include automobile toys running on a locus with a sound such as melody, engine noise and siren, train toys running on a locus with a whistle, animal toys movable on a locus with a cry, and automobile or train toys running with emission of light. The movable toy and water adhesion unit, and optionally sheet material can be combined to form a movable toy set having an excellent portability.

EXAMPLE 1 (SEE FIGS. 1 to 4)

Preparation of Movable Toy

A plastic main body 2 has a motor 3 and a reduction gear 4 provided thereinside at the rear part thereof and a movable body 5 (wheel) provided thereoutside at the rear part thereof. The movable body 5 rotates when driven by the motor 3 via the gear 4.

The main body 2 also has a motor 3', a reduction gear 4' and a movable body 5' (wheel) mounted therein in the same arrangement as mentioned above.

An energizing detecting unit 20 having three elements 6, 7, 8 is provided in the main body 2 of the movable toy. The main body 2 has the elements 6, 7 and 8 provided at the front part thereof piercing the bottom to the back surface thereof. These elements are electrically connected to a circuit 9.

The main body 2 further comprises a pair of wheels mounted thereon at the front part thereof. These wheels are fake wheels which don't come in contact with a play surface, e.g., a floor, when the toy is placed thereon and don't rotate.

Figure 4:
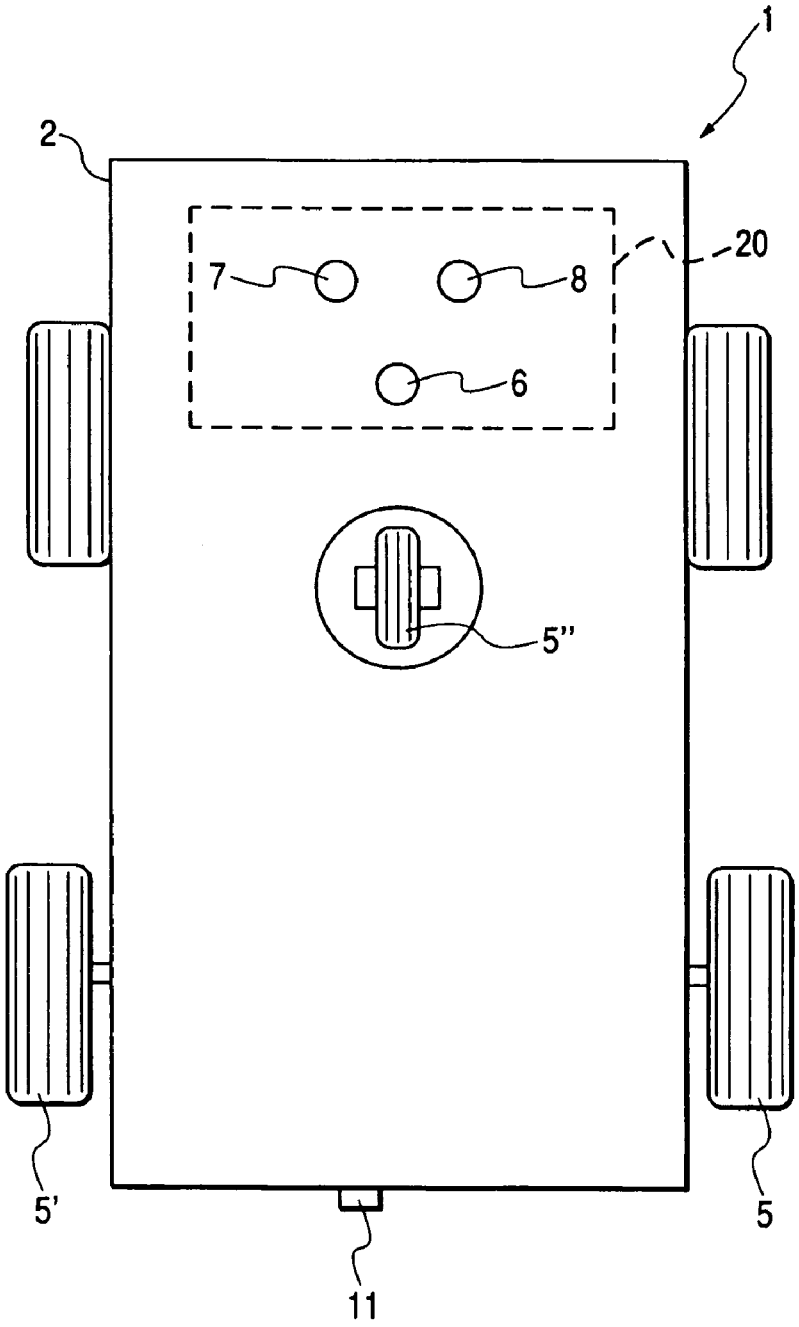
FIG. 4 is a diagram illustrating the state of the first embodiment of the movable toy of the invention as viewed from under.
Figure 5:
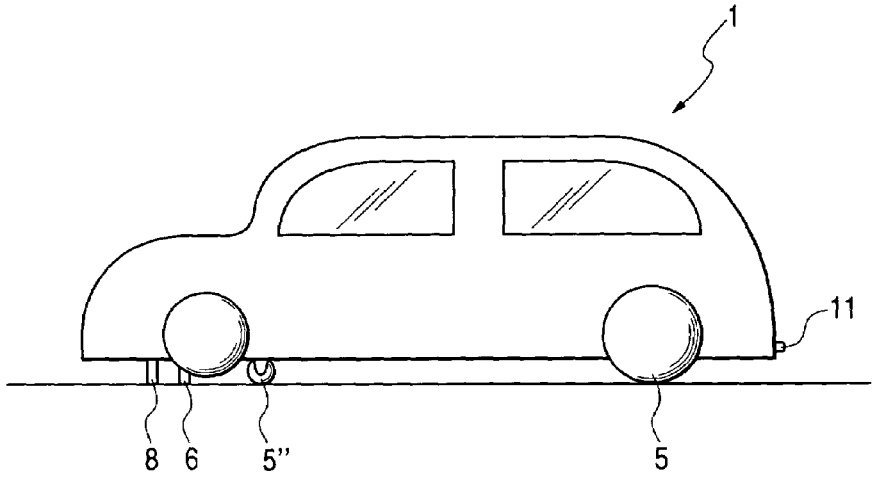
FIG. 5 is a diagram illustrating the state of the first embodiment of the movable toy of the invention as viewed from side.

At substantially the central part of the outer part of the main body 2 is provided a wheel 5"0 which can rotate in all directions (see FIG. 4). The circuit 9 is electrically connected to the motor 3 and the power supply 10 to which an ON-OFF switch 11 is connected.

When the movable toy in automobile form thus obtained is placed on a locus (water locus formed on a floor or other play surface) with the switch 11 ON, the circuit 9 detects the state that all the elements 6, 7 and 8 are energized so that the motors 3, 3' rotates. As a result, while the movable bodies 5, 5' rotate via the gears 4, 4', the movable toy goes straight ahead (FIG. 1).

Figure 2:
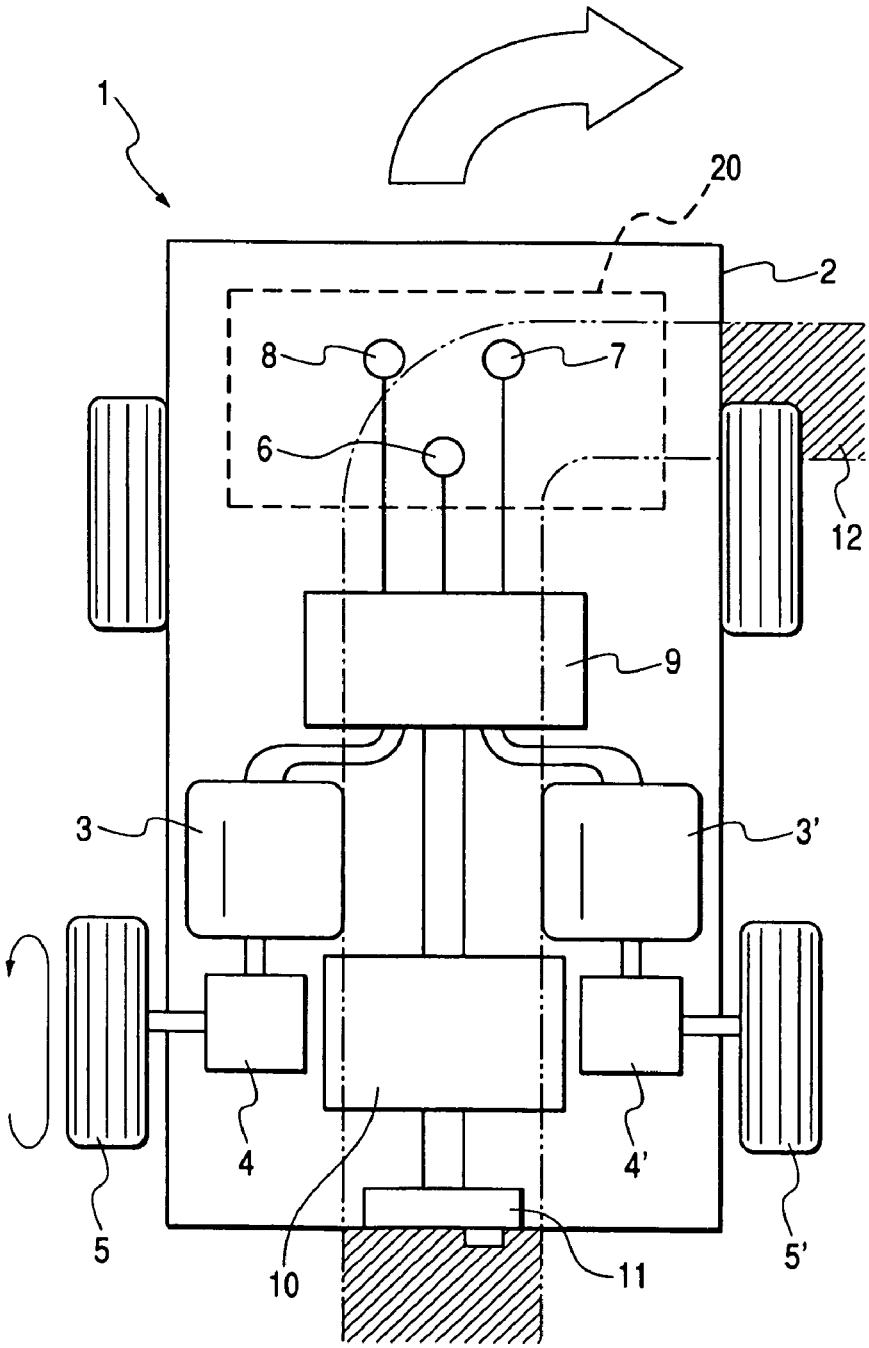
FIG. 2 is a diagram illustrating the state of the first embodiment of the movable toy of the invention as viewed from above.

When the movable toy moves until it reaches a right curve where the element 8 runs off the locus, the circuit 9 detects the state that only the elements 6 and 7 are energized to cause the motor 3 to rotate. As a result, the movable body 5 rotates via the gear 4, causing the movable toy 1 to take a right turn (FIG. 2).

Figure 3:
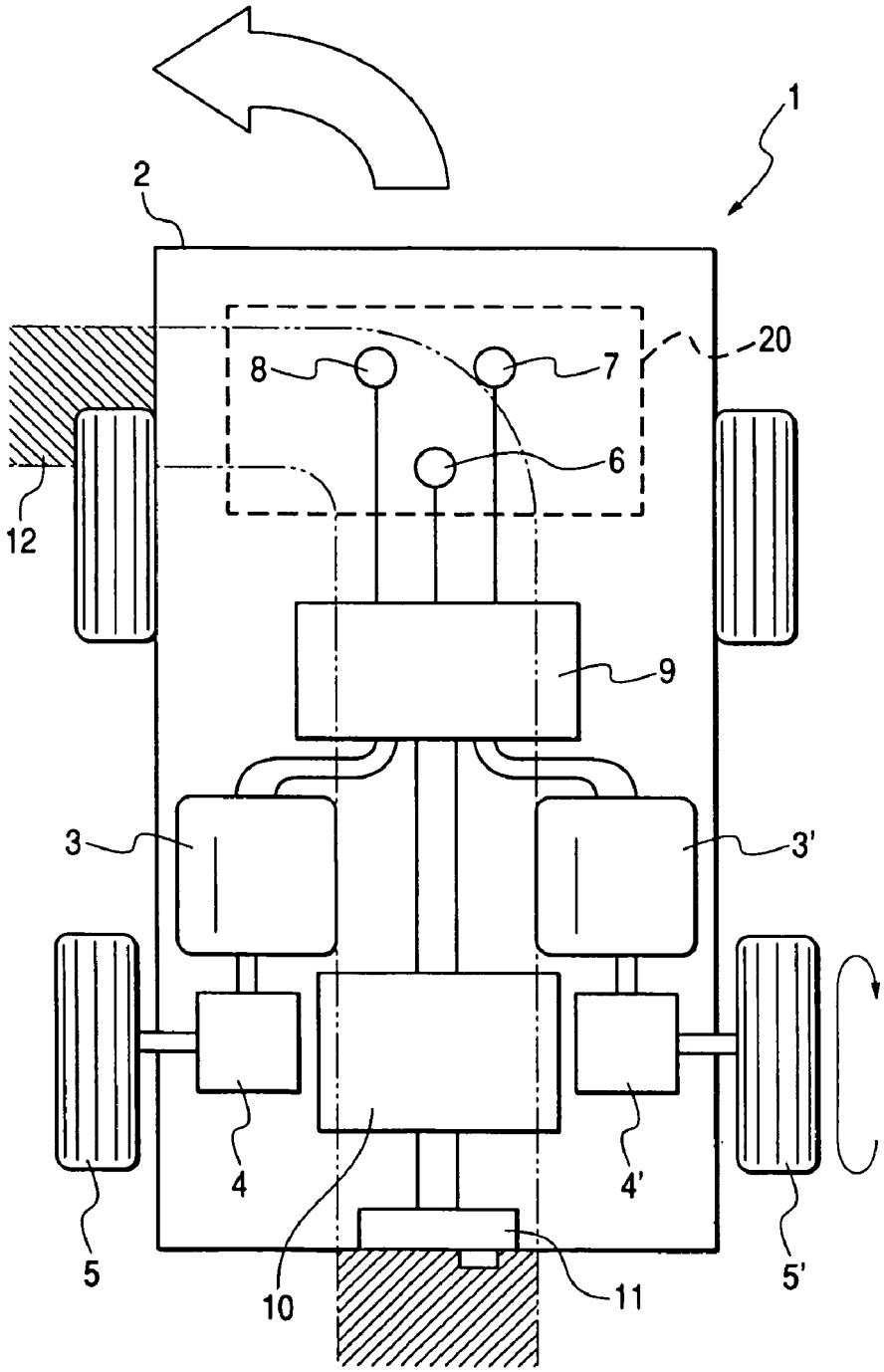
FIG. 3 is a diagram illustrating the state of the first embodiment of the movable toy of the invention as viewed from above.

When the movable toy continues to move until it reaches a left curve where the element 7 runs off the locus, the circuit 9 detects the state that only the elements 6 and 8 are energized to cause the motor 3' to rotate. As a result, when the movable body 5' rotates via the gear 4', the movable toy 1 takes a left turn (FIG. 3).

When the movable toy 1 runs off the locus to deenergize all the elements, the circuit 9 detects this state to suspend the rotation of the motor 3' and then the motor 3 rotates. As a result, the movable body 5 rotates via the gear 4, and the movable toy 1 takes a right turn. When the movable toy is kept in this state for 1 minute, the movable toy automatically stops (not shown).

EXAMPLE 2

Preparation of Movable Toy Set

Figure 7:
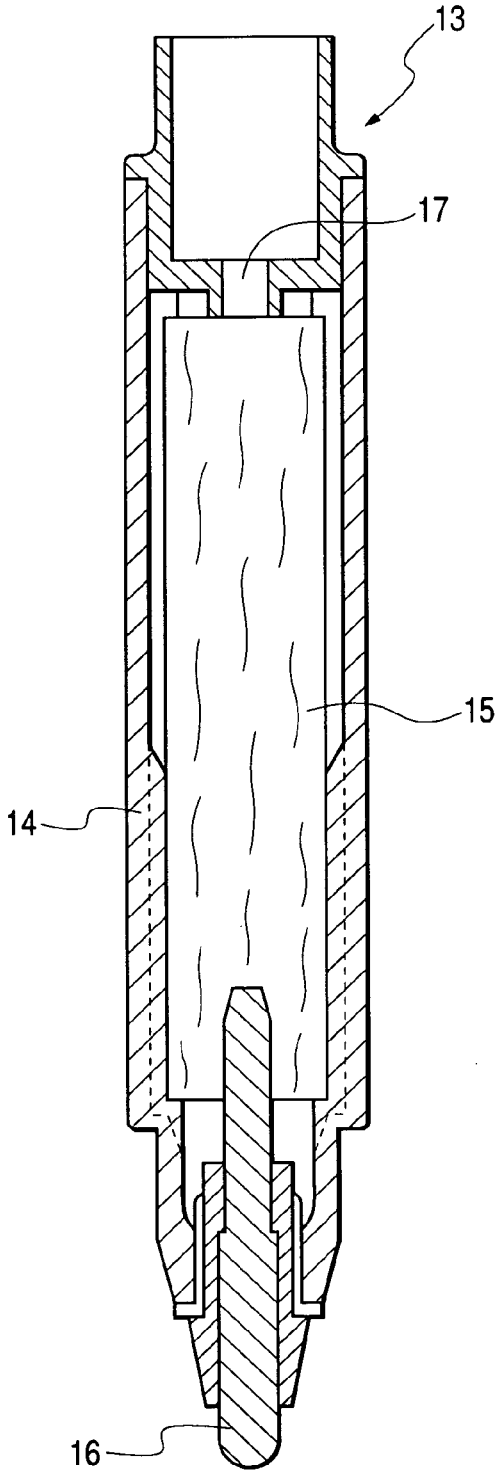
FIG. 7 is a diagram illustrating the state of a movable toy set of the example 2.

A coating device using for a movable toy set of the example 2 shows in FIG. 7. A water absorber 15 was received within a cylinder 14. At the forward end of the cylinder 14 was provided a pen head 16 made of a processed fiber connected to the water absorber 15. At the rear end of the cylinder 14 was provided a hole 17 communicating to the exterior, a coating device 13 was prepared. The coating device as shown in FIG. 7 and the movable toy of Example 1 were combined to obtain a movable toy set of the example 2.

Water was injected into the coating device through the hole so that water can be discharged from the pen head. Thereafter, when a desired locus was drawn on a floor, and the movable toy was then placed on the locus, the movable toy set was able to run on the track.

EXAMPLE 3

Preparation of Movable Toy Set

Figure 8:
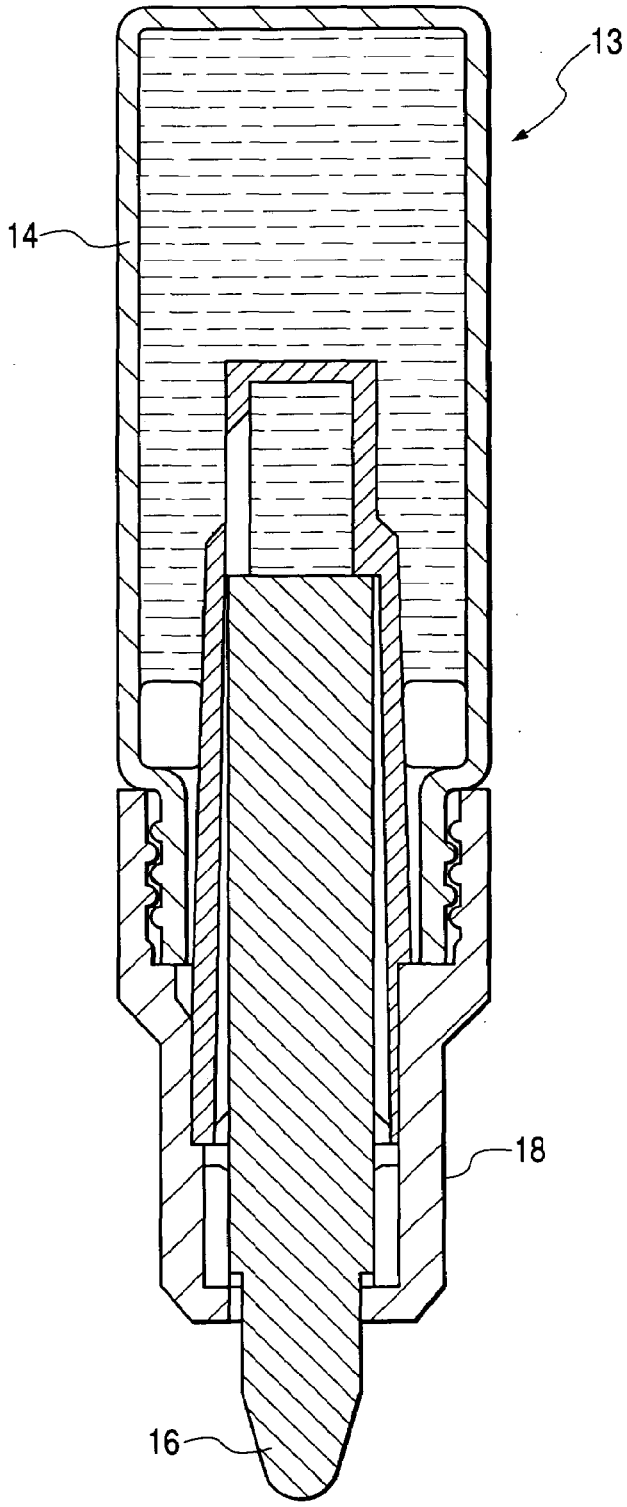
FIG. 8 is a diagram illustrating the state of a movable toy set of the example 3.

A coating device using for a movable toy set of the example 3 shows in FIG. 8. A coating device 13 comprising a holder 18 for retaining a pen head 16 made of a processed fiber and a cylinder 14 capable of directly receiving water therein was prepared. The cylinder 14 was pierced at the forward end thereof with a hole through which water is injected thereinto. The holder 18 was arranged so as to be detached from the injection hole. The holder 18 was mounted in the injection hole to air tightly seal the cylinder 14. The coating device as shown in FIG. 8 and the movable toy of Example 1 were combined to obtain a movable toy set of the example 3.

In operation, water was injected into the cylinder through the injection hole. The holder was then fitted in the injection hole so that water can be discharged from the pen head. Thereafter, when a desired locus was drawn on a floor, and the movable toy was then placed on the locus, the movable toy set was able to run on the track.

EXAMPLE 4

Preparation of Sheet Material

Figure 9:
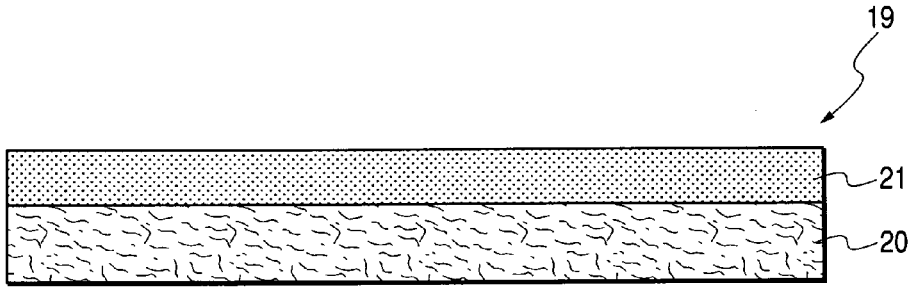
FIG. 9 is a diagram illustrating the state of a sheet material using for a movable toy set of the example 4.

A sheet material using for a movable toy set of the example 4 shows in FIG. 9. Using a white screen printing ink obtained by uniformly mixing 15 parts of a wet process particulate silica [tradename: Nipseal E-200, produced by Nippon Silica Industrial Co., Ltd.], 30 parts of an urethane emulsion [trade name: Hydran HW-930, produced by DAINIPPON INKAND CHEMICALS, INCORPORATED], 50 parts of water, 0.5 parts of a silicone-based anti-foaming agent, 3 parts of an aqueous ink thickening agent, 1 part of ethylene glycol and 3 parts of a block isocyanate-based crosslinking agent, and then stirring the mixture, solid printing was made on the entire surface 20 of a pink polyester satin textile (weight: 90 g/m$^2$) through a 80-mesh screen plate. The printed matter was then dried and cured at a temperature of 130° C. for 5 minutes to form a porous layer 21. Thus, a water-discolorable sheet material 19 was obtained.

The water-discolorable sheet material was entirely viewed while in dried state.

Preparation of Movable Toy Set

The water-discolorable sheet material, the movable toy of Example 1 and the coating device of Example 3 were combined to obtain a movable toy set.

In operation, water was injected into the cylinder through the injection hole. The holder was then fitted in the injection hole so that water can be discharged from the pen head. Thereafter, when a desired locus was drawn on the surface of the water-discolorable sheet material, the water-discolorable sheet material became transparent at the locus thus drawn, making a pink locus visually recognizable.

When the movable toy was placed on the locus to undergo operation, the movable toy was able to run on the locus.

The locus was kept wet with water. When dried, the locus became opaque to assume the original white color.

EXAMPLE 5

Figure 6:
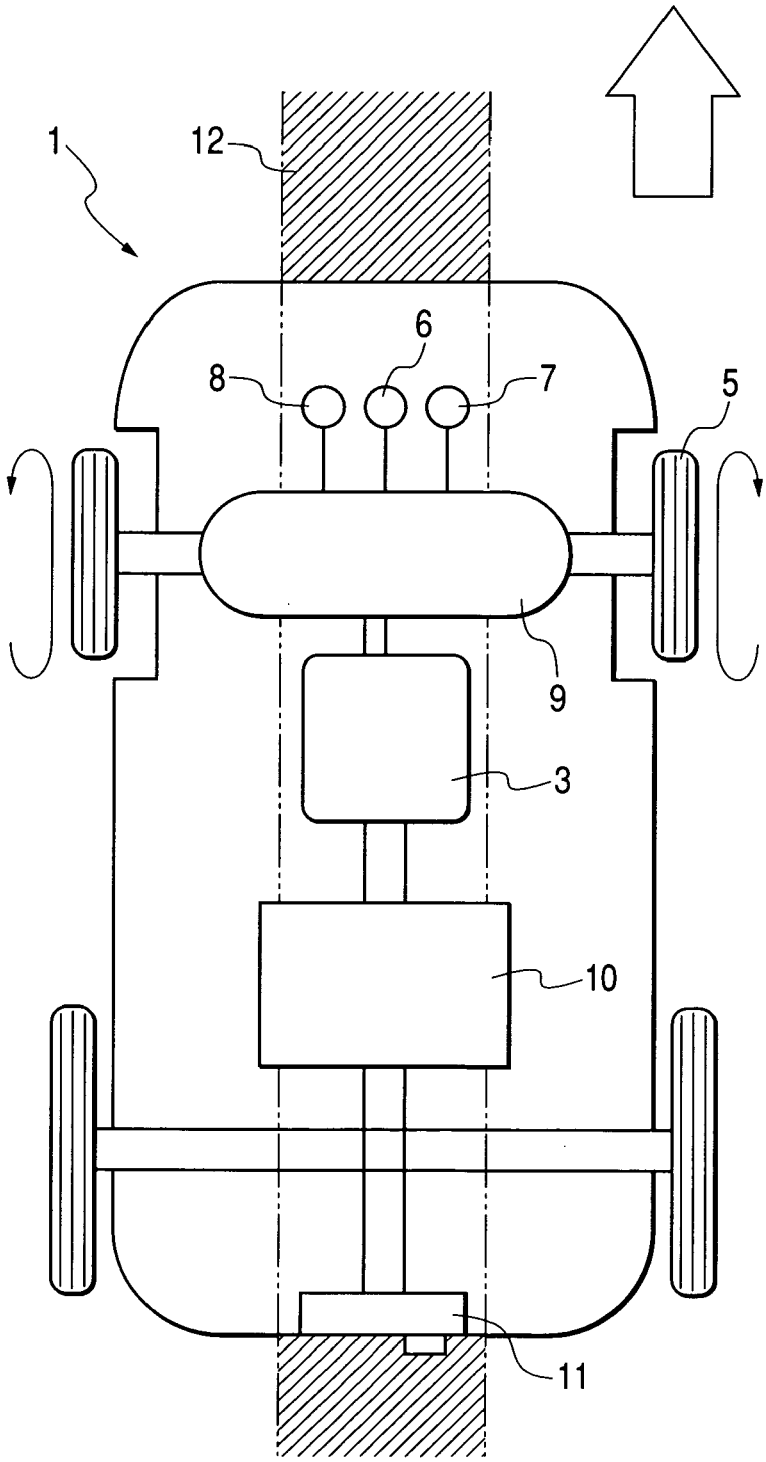
FIG. 6 is a diagram illustrating the state of another embodiment of the movable toy of the invention as viewed from above.

Preparation of Movable Toy (See FIG. 6)

A plastic main body 2 has a motor 3, a circuit 9 comprising a gear and a mechanism for changing the position of wheels, and movable toys 5 (wheels) connected to the right side and left side of the circuit 9, respectively, provided at substantially the central part of the interior thereof. The movable toys 5 rotate via the gear when driven by the motor 3.

The main body 2 has elements 6, 7 and 8 provided at the front part thereof piercing the bottom to the back side thereof. These elements are electrically connected to the circuit 9.

The main body 2 has a pair of wheels rotatably provided at the rear part thereof.

The motor 3 is electrically connected to a power supply 10 to which an ON-OFF switch 11 is connected.

When the movable toy 1 in train form thus obtained is placed on a locus (water locus formed on a floor) with the switch 11 ON, the circuit 9 detects the state that all the elements 6, 7 and 8 are energized to cause the motor 3 to rotate. Thus, the movable body 5 rotates to cause the movable toy 1 to go straight ahead (FIG. 1).

When the movable toy 1 continues to move until it reaches a right curve where the element 8 runs off the locus, the circuit 9 detects the state that only the elements 6 and 7 are energized to cause the movable bodies to be displaced to right. As a result, the movable toy 1 takes a right turn (not shown).

When the movable toy 1 continues to move until it reaches a left curve where the element 7 runs off the locus, the circuit 9 detects the state that only the elements 6 and 8 are energized to cause the movable bodies to be displaced to left. As a result, the movable toy 1 takes a left turn (not shown).

When the movable toy runs off the locus to deenergize all the elements, the circuit 9 detects this state to cause the movable bodies to be displaced to right or left. As a result, the movable bodies rotate. When the movable toy is kept in this state for 1 minute, the movable toy automatically stops (not shown).

Preparation of Sheet Material

Using a fluorescent pink ink obtained by uniformly mixing 5 parts of a particulate fluorescent pink pigment [trade name: Epocolor FP-112, produced by NIPPON SHOKUBAI CO., LTD.], 50 parts of an acrylic acid ester emulsion [trade name: Mowinyl 763, produced by Hoext Gosei K. K.; solid content: 48%], 3 parts of an aqueous ink thickening agent, 0.5 parts of a leveling agent, 0.3 parts of an antifoaming agent and 5 parts of an epoxy-based crosslinking agent, and then stirring the mixture, solid printing was made on a white cotton satin textile (weight: 130 g/m$^2$) having a size of 1 m×1 m having an urethane elastomer sheet having a thickness of 3 $\mu$m stuck to the back side thereof as a support through a 180-mesh screen plate. The printed matter was then dried and cured at a temperature of 100° C. for 3 minutes to form a colored layer. Subsequently, using a white screen printing ink obtained by uniformly mixing 15 parts of a wet process particulate silica [Nippon Silica Industrial Co., Ltd. ], 30 parts of an urethane emulsion [trade name: Hydran HW-930, produced by DAINIPPON INK AND CHEMICALS, INCORPORATED], 50 parts of water, 0.5 parts of a silicone-based anti-foaming agent, 3 parts of an aqueous ink thickening agent, 1 part of ethylene glycol and 3 parts of a block isocyanate-based crosslinking agent, and then stirring the mixture, solid printing was made on the entire surface of the colored layer through a 80-mesh screen plate. The printed matter was then dried and cured at a temperature of 130° C. for 5 minutes to form a white porous layer. Thus, a water-discolorable sheet material was obtained.

Provided in the vicinity of the porous layer of the sheet was a display of letters and patterns made of an ordinary printing ink to provide the product with commercial value and design.

The water-discolorable sheet material assumed white color at the porous layer while in dried state.

Preparation of Movable Toy Set

The movable and sheet material and the coating device of Example 3 were combined to obtain a movable toy set.

In operation, water was injected into the cylinder through the injection hole. The holder was then fitted in the injection hole so that water can be discharged from the pen head. Thereafter, when a desired locus was drawn on the surface of the sheet material, the porous layer became transparent at the locus thus drawn, making a pink locus visually recognizable.

When the movable toy was placed on the locus to undergo operation, the movable toy was able to run on the locus.

The locus was kept wet with water. When dried, the locus became opaque to assume the original white color.

In accordance with the invention, the locus on which the toy moves can be more easily and arbitrarily predetermined to give surprise and variety in running, making it possible to provide a movable toy having higher toy properties.

Further, a movable toy set comprising the movable toy in combination with a water adhesion unit and optionally a sheet material can provide a toy set excellent in convenience of predetermining locus as well as in portability.

What is claimed is:

1. A movable toy set, comprising:

a main toy body including an energizing detecting unit having three or more elements, said main toy body having said energizing detecting unit on a bottom surface thereof; and a movable body for moving said movable toy;

wherein said movable body selectively moves depending on an energized state of said elements;

a water adhesion unit for providing a locus on a play surface, wherein one or more of said elements reaches an energized state when said one or more of said elements is in contact with the locus on the play surface wherein said water adhesion unit includes writing utensils or coating device, and wherein said water adhesion unit comprises a plastic porous material or processed fiber having an open cell as a forward end member; and a sheet member for functioning as the play surface, wherein said sheet member includes a water-discolorable sheet material, and wherein said sheet member further comprises a porous layer having a low refractivity pigment, and wherein aid porous layer is fixed and dispersed in a binder resin on a surface of a support member of said sheet member, and wherein said porous layer has difference in transparency between when said sheet member absorbs liquid and when said sheet member doesn't absorb liquid.

2. The movable toy according to claim 1, wherein said energizing detecting unit comprising three elements (A, B and C), and wherein said movable body includes a pair of movable bodies, and wherein said pair of movable bodies move on a condition that all said three elements are energized, and wherein one of said movable bodies moves on a condition that two (A and B) of said three elements are energized, and wherein the other of said movable bodies moves on a condition that two (A and C) of said three elements are energized.

3. The movable toy according to claim 2, wherein the one of movable bodies moves on a condition that none of said three elements are energized.

4. A movable toy set, comprising:

a main toy body including:

a motor an energizing detecting unit having three or more elements, said energizing detecting unit provided on a bottom surface of said main toy body; and a movable body including wheels, said wheels displaced by driving said motor, wherein said wheels are selectively displaced depending on an energized state of said elements so that said movable toy moves, a water adhesion unit for providing a locus on a play surface, wherein one or more of said elements reaches the energized state when said one or more of said elements is in contact with the locus on the play surface, wherein said water adhesion unit includes writing utensils or coating device, said water adhesion unit comprising a plastic porous material or processed fiber having an open cell as a forward end member; and a sheet member for functioning as the play surface, wherein said sheet member includes a water-discolorable sheet material, and wherein said sheet member further comprises a porous layer having a low refractivity pigment, and wherein aid porous layer is fixed and dispersed in a binder resin on a surface of a support member of said sheet member, and wherein said porous layer has difference in transparency between when said sheet member absorbs liquid and when said sheet member doesn't absorb liquid.

5. The movable toy according to claim 4, wherein said energizing detecting unit includes three elements (A, B, C), and wherein said wheels are displaced in such an arrangement that said movable toy goes straight in its forward direction, when all said three elements are energized, and wherein said wheels are displaced in such an arrangement that said movable toy goes rightward when two (A, B) of said three elements are energized, and wherein said wheels are displaced in such an arrangement that said movable toy goes leftward when two (A, C) of said three elements are energized.

6. The movable toy according to claim 5, wherein said wheels are displaced in such an arrangement that the movable toy goes rightward or leftward, when none of said three elements are energized.

* * * * *